United States Patent [19]

Skala

[11] 4,279,227

[45] Jul. 21, 1981

[54] HEAT STORAGE IN BY-PRODUCTS OF AN INTERMITTENT PROCESS

[76] Inventor: Stephen F. Skala, 3839 S. Wenonah, Berwyn, Ill. 60402

[21] Appl. No.: 79,322

[22] Filed: Sep. 27, 1979

Related U.S. Application Data

[63] Continuation-in-part of Ser. No. 301,285, Oct. 27, 1972, abandoned, and a continuation-in-part of Ser. No. 457,207, Apr. 2, 1974, Pat. No. 3,911,284, and a continuation-in-part of Ser. No. 464,454, Apr. 26, 1974, abandoned, and a continuation-in-part of Ser. No. 578,527, May 19, 1975, Pat. No. 4,020,798, and a continuation-in-part of Ser. No. 779,788, Mar. 21, 1977, Pat. No. 4,189,916.

[51] Int. Cl.[3] ..... F02N 17/02

[52] U.S. Cl. ..... 123/179 H; 123/543; 123/546

[58] Field of Search ..... 123/179 H, 1 A, 3, 122 AA, 123/142.5 R; 60/39.46 R, 39.46 S, 311; 165/1, 2, 47, 48, 58

[56] References Cited

U.S. PATENT DOCUMENTS

| | | | |
|---|---|---|---|
| 3,758,031 | 9/1973 | Moran | 123/142.5 R |
| 3,987,773 | 10/1976 | Harrow et al. | 123/122 AA |
| 4,020,798 | 5/1977 | Skala | 123/1 A |
| 4,164,253 | 8/1979 | Skala | 165/1 |
| 4,167,165 | 9/1979 | Finlay et al. | 123/122 AA |
| 4,189,916 | 2/1980 | Skala | 60/311 |
| 4,192,371 | 3/1980 | Derouette et al. | 165/1 |
| 4,199,021 | 4/1980 | Thoma | 165/1 |

*Primary Examiner*—P. S. Lall

[57] ABSTRACT

In an intermittent process, hot reaction by-products are collected and stored in a thermal reservoir to provide heat when the process is not operating. In the preferred embodiment of a vehicle having a heat engine which derives power from a reaction of an alkali metal with water, molten alkali hydroxides are separated from a gaseous exhaust and stored in a thermal reservoir. In frigid weather prior to starting, a thermal exchange fluid transfers heat from the thermal reservoir to melt sufficient alkali metal and water to assure an engine start.

10 Claims, 3 Drawing Figures

HEAT STORAGE IN BY-PRODUCTS OF AN INTERMITTENT PROCESS

CROSS REFERENCES TO RELATED APPLICATIONS

This application is a continuation-in-part of Ser. No. 301,285 filed Oct. 27, 1972 and now abandoned; and is a continuation-in-part of Ser. No. 457,207 filed Apr. 2, 1974 and now U.S. Pat. No. 3,911,284; and is a continuation-in-part of Ser. No. 464,454 filed Apr. 26, 1974 and now abandoned; and is a continuation-in-part of Ser. No. 578,527 filed May 19, 1975 and now U.S. Pat. No. 4,020,798; and is now a continuation-in-part of Ser. No. 779,788 filed Mar. 21, 1977 and now U.S. Pat. No. 4,189,916.

Ser. No. 950,845 entitled Internal Combustion Engine Based on Reactant Contact Ignition.

Ser. No. 081,668 entitled Exhaust Gas Treatment by a Reactant

BACKGROUND

This invention relates to thermal storage and particularly to storage of heat in reaction by-products of intermittent processes.

The preferred embodiment relates to a vehicle having an engine which derives power from a reaction of an alkali metal with water in the presence of air which reaction forms hot alkali hydroxides as disclosed in my U.S. Pat. No. 4,020,798. The alkali metal and water reactants are subject to freezing in frigid weather. The freezing temperature of water could be lowered well below the −12.3° C. freezing temperature of the eutectic alloy of sodium and potassium, called NaK, by addition of an alcohol which would burn when ignited in the engine. Similarly, the freezing temperature of NaK could be lowered by alloying with cesium down to the −72° C. freezing temperature of the ternary eutectic alloy. Addition of alcohol and cesium, however, would add to system complexity and cost and it is preferable to provide means to retard freezing and to thaw the reactants should freezing occur. Such thawing means could also provide other heating functions such as warming the vehicle's interior.

OBJECTS AND SUMMARY

It is an object to provide a source of heat in a vehicle to thaw frozen reactants.

It is another object to provide an improved method for storing by-product heat for use during nonoperating periods of intermittent processes.

These and other objects and advantages are attained in accordance with the invention wherein a plurality of reactants produce a useful product, such as mechanical energy, and hot reaction by-products which are collected and stored in a thermal reservoir to provide heat for users when the reaction process is not operating.

The preferred embodiment is a vehicle based on alkali metal, water, and oxygen reactants which include hot alkali hydroxides as reaction products. The hot alkali hydroxides are collected in a thermal reservoir during vehicle operating periods. After a prolonged nonoperating period at ambient temperatures below the freezing temperature of any of the reactants, heat is transferred from the thermal reservoir to portions of the engine in which reactants may be frozen thereby melting the reactants for injection into the engine which assures starting. The transfer of heat from the thermal reservoir to users, which include the frozen reactant and engine portions and may also include a space heater, is attained by circulating a thermal exchange fluid in a fluid circuit which includes heat exchange means within the thermal reservoir and the users.

DESCRIPTION OF THE DRAWINGS

FIG. 1 shows portions of a vehicle system which form reaction products and evolve heat for storage and subsequent recovery of the heat.

Figure 3:
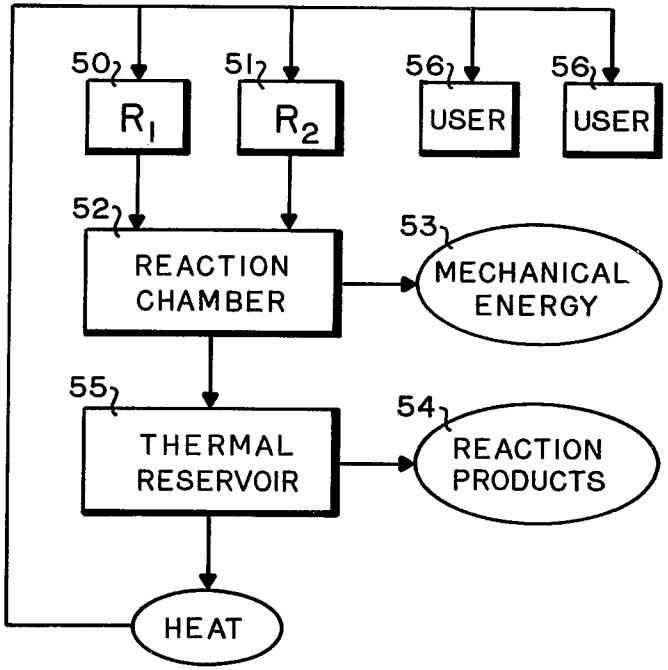
FIG. 3 is a flow diagram of a general process in which the invention is embodied.

Internal combustion engine 10 derives mechanical energy from heat evolved in a reaction of NaK or other alkali metal with water in the presence of air. The reaction occurs in two steps. The first step is a reaction of NaK with water which occurs spontaneously and instantly upon contact as a consequence of negligible activation energy. Accordingly, reaction, starting, and operation are assured whenever the NaK-water reactants can be brought into contact within a combustion chamber in an expansion phase which is a highly reliable process if freezing of the reactants can be avoided. Reaction products of the NaK-water reaction comprise hydroxides of the alkali metals and hydrogen which are formed at high temperature. The second step of reaction comprises by-product hydrogen reacting with the oxygen component of air to form water vapor and to evolve additional heat approximating that of the NaK-water reaction. In normal operation with NaK and water injected into air at maximum compression, the hydrogen ignites with negligible delay to complete the reaction. All of the reaction products are normally formed in a gaseous phase. As cooling occurs during an expansion phase within the combustion chamber, the alkali hydroxide vapors condense to a molten mist within a gas comprising water vapor, nitrogen, and unreacted oxygen. The engine may include a plurality of combustion chambers and may operate in two or four stroke cycles with injection of the reactants at substantially maximum compression for reaction at substantially constant volume.

Within reactant injector assembly 11, components not shown inject NaK and water simultaneously into each combustion chamber over a predetermined portion of the cycle. Each reactant has a separate injection assembly to provide injection of the reactants as colliding jets which assures their contact and rapid reaction. Pumps to provide a pulsed charge of the reactants to the injectors, as well as the injectors themselves, are located within the reactant injector assembly which may be thermally insulated to retard heat loss.

During a fuel stop, the reactants are dispensed and accumulated reaction products are removed. NaK is pumped into a thermally insulated NaK reservoir 15 and water is pumped into a thermally insulated water reservoir 16. The reactants are delivered to the reactant injector assembly by NaK conduit 17 and water conduit 18.

During engine operating periods, the exhaust comprising a NaK hydroxide mist in a gas passes from the engine 10 to a thermal reservoir 20 through an exhaust manifold and pipe 21. The thermal reservoir derives heat from the exhaust and stores the heat as latent heat of crystalization in a heat storing material consisting of accumulated NaK hydroxide. A substantial portion of the molten mist is separated from the gaseous exhaust components by impingement upon liquid surfaces of NaK hydroxide on the body of accumulated NaK hydroxide 22 and as a film on baffle plates 23. Exhaust gases with remaining NaK hydroxide mist pass through pipe 25 to additional stages of separation such as filters not shown but disclosed in copending application Ser. No. 779,788 now U.S. Pat. No. 4,189,916. Excess NaK hydroxide flows through pipe 26 into a storage vessel, not shown, from which it is removed during a fuel stop.

Heat is transferred from the thermal reservoir to heat reactants above their freezing temperatures by a thermal exchange fluid in a fluid circuit comprising a supply main 30, a return main 31, a pump 32 to develop a differential pressure between the supply and return mains, and control valves 33A, 33B, and 33C to regulate flow of the thermal exchange fluid through heat exchangers 34A, 34B, 34C and 34D. During engine operating periods in frigid weather, heat is transferred from the thermal reservoir to heat the water and NaK reservoirs by operating pump 32 and opening valves 33A and 33B so that thermal exchange fluid circulates in paths which include heat exchangers 34A, 34B, and 34D. As the water and NaK attain predetermined temperatures, valves 33A and 33B close. Reactant freezing is not expected to occur between operating periods within a day. For starting after a substantial nonoperating period in frigid weather, the reactant injector assembly is heated to thaw frozen reactants by circulating the thermal exchange fluid in a path which includes heat exchangers 34C and 34D. Heat exchange means within the reactant injector assembly may include thermally conductive contact and forced air convection.

The thermal exchange fluid is selected to remain in a liquid phase at hot thermal reservoir temperatures as well as low ambient temperatures. Suitable thermal exchange fluids include aromatic hydrocarbons such as "Therminol 60" manufactured by Monsanto Corporation which has a useful temperature range of −60° F. to 600° F.

Figure 1:
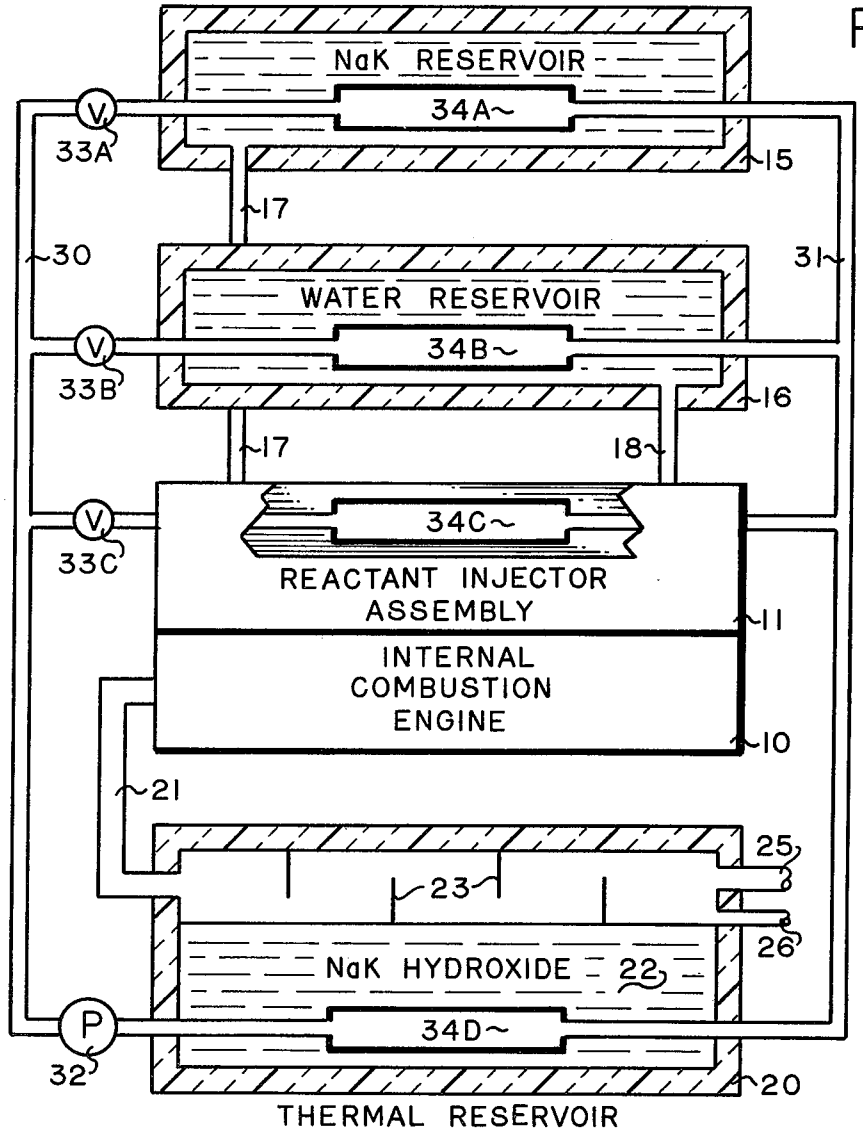
FIG. 1 is a diagrammatic drawing partly in cross-section showing storage of hot reaction products from an engine and means to transfer the heat to melt reactants according to the preferred embodiment of the invention.
Figure 2:
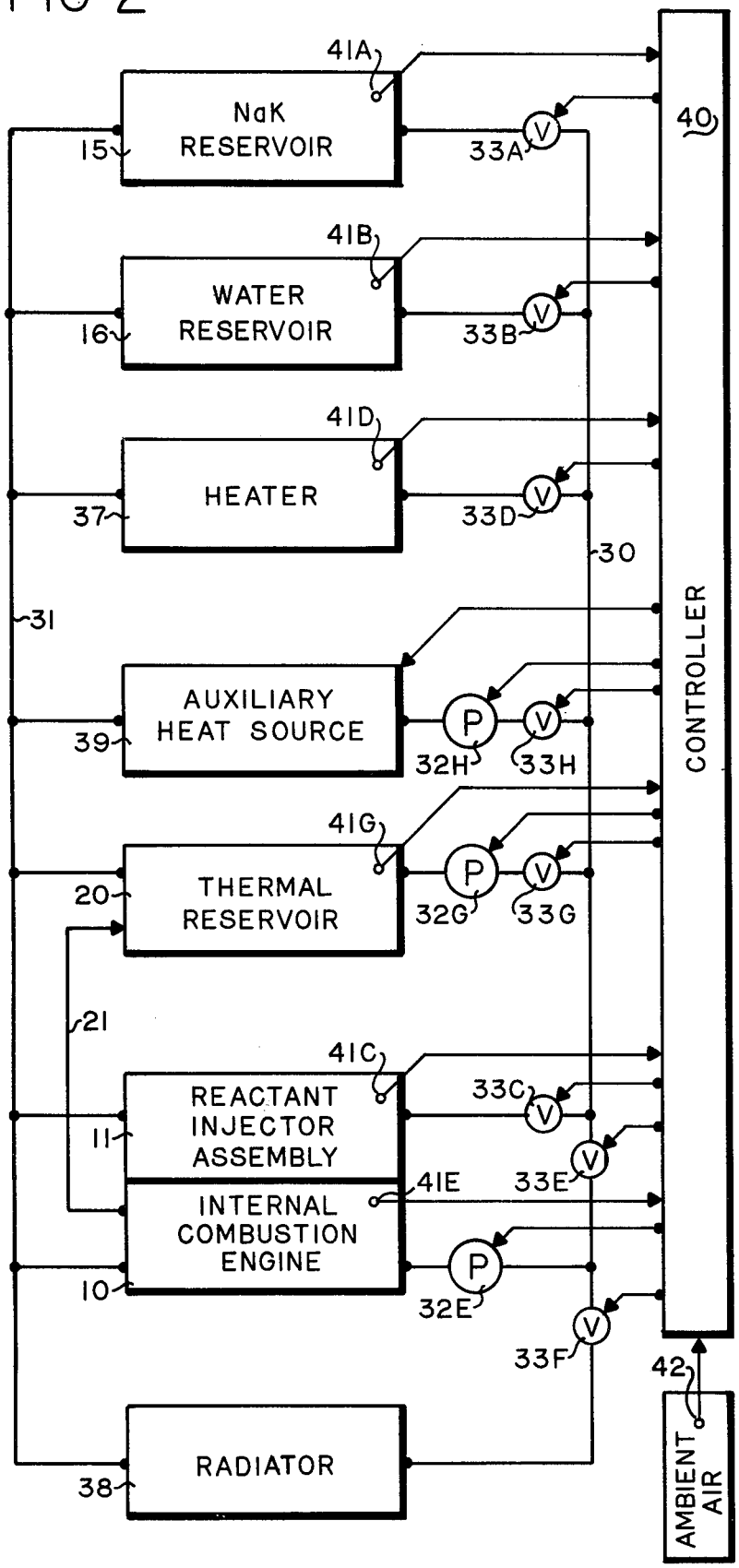
FIG. 2 is a block diagram of a fluid circuit and system for selectively exchanging heat among sources and sinks in the preferred embodiment.

FIG. 2 extends the system shown in FIG. 1 by including an auxiliary heat input for starting after prolonged nonoperating periods, a cooling fluid circuit which shares thermal exchange fluid with the heating fluid circuit, alternative means for heating the NaK and water reservoirs, and a programmable controller for automatic operation of valves and pumps to transfer heat automatically according to a program in response to sensed temperatures.

During engine operating periods, thermal reservoir 20 receives hot exhaust from engine 10 through pipe 21. Thermal exchange fluid absorbs heat and, during frigid weather, is circulated through a heating fluid circuit which includes supply main 30 and return main 31. Pump 32E operates and valve 33E is open to develop a differential pressure between the supply and return mains. Valves 33A, 33B, and 33D are open to admit flow of thermal exchange fluid through NaK reservoir 15, water reservoir 16, and space heater 37 for the vehicle interior, each of which includes a heat exchanger, not shown. As the NaK and water reservoirs attain predetermined temperatures, valves 33A and 33B close. As the thermal exchange fluid in the engine approaches a maximum operating temperature, valve 33F opens and the thermal exchange fluid flows through radiator 38 to be cooled by heat exchange with ambient air.

For starting after a substantial nonoperating period of approximately a day or less in frigid weather, pump 32G operates, valves 33G and 33C open, and other valves remain closed thereby providing a circulation path for the thermal exchange fluid which includes thermal reservoir 20 and reactant injector assembly 11 and exchanges heat therebetween. As NaK and water in the reactant injector assembly thaw and the engine is started, valve 33C closes and valve 33D opens for rapid heating of the vehicle interior by heater 37.

For starting after prolonged nonoperating periods of several days or more in frigid weather, auxiliary heat source 39 operates to evolve heat, pump 32H operates, valves 33H and 33C open, and other valves remain closed thereby providing a circulation path for the thermal exchange fluid which includes the auxiliary heat source and the reactant injector assembly. The heater 37 may also be operated by opening valve 33D. The auxiliary heat source may derive its heat from any energy source, but combustion of fluid hydrocarbons is preferred. Heat from the burning hydrocarbon is transferred to the thermal exchange fluid through a heat exchanger, not shown. Further details for an engine independent coolant preheating system may be found in U.S. Pat. No. 3,758,031 issued to J. P. Moran.

The valves and pumps which determine flow of thermal exchange fluid receive power for their operation from controller 40 which includes a program for temperature setpoints. The system of FIG. 2 is regulated to attain the temperature setpoints in response to sensed temperatures by known servo methods. As an example of system operation by the controller, a driver enables the controller by a starting switch, not shown. If the temperature of sensor 41C is below a setpoint temperature to indicate that reactants in the reactant injector assembly may be frozen and if sensor 41G indicates that adequate heat is retained by the thermal reservoir, the controller provides power to operate pump 32G and to open valves 33G and 33C to transfer heat as described previously. After starting, ambient air sensor 42 is compared to a setpoint temperature so that in frigid weather the controller provides power to operate pump 32E and open valves 33E, 33A, and 33B to heat the NaK and water reservoirs and to regulate valve 33D to attain a setpoint temperature within the vehicle. Similar operation by the controller of the other pumps, valves, and assemblies to attain setpoint temperatures is apparent.

The present vehicle system for heating and cooling derives advantages from the non-aqueous thermal exchange fluid having a low vapor pressure at high temperatures. As a stable hydrocarbon, the thermal exchange fluid would not react with NaK should a leak occur. For vehicles generally, the thermal exchange fluid does not contribute to corrosion of heat exchangers or engine components, the low vapor pressure allows higher coolant temperature at atmospheric pressure which improves efficiency by reducing engine heat loss, and the higher temperature provides more effective heat transfer.

FIG. 3 shows a more general aspect of the invention where, in an intermittent or batch process, a plurality of reactants react to form hot reaction products which are stored in a thermal reservoir to provide a source of heat when the reaction process is not operating.

A first reactant 50 and a second reactant 51 react in a reaction chamber 52 to produce a useful product, such as mechanical energy 53, and to form hot reaction products 54 which first enter thermal reservoir 55. The reaction is characterized as intermittent with operating periods alternating with nonoperating periods of substantial duration as in the example of a vehicle. While retained in the thermal reservoir, the reaction products function as a source of heat which can be transferred to other apparatus used in the process such as the reactants 50 and 51 and other users 56 such as room heaters and other industrial equipment. After useful heat has been transferred from the reaction products, they are removed from the thermal reservoir to allow replacement by another batch of hot reaction products from subsequent reaction processes.

What I claim is:

1. A system for producing heat and for transferring the heat in a vehicle comprising a heat engine which forms collectable hot reaction by-products and requires a heat input for starting after a substantial nonoperating period in frigid weather, means to collect the hot reaction by-products in an insulated vessel to comprise a thermal reservoir wherein heat is stored in the reaction by-products, and a fluid circuit to circulate a thermal exchange fluid in selectable paths which include heat exchangers in the engine and in the thermal reservoir to provide heat transfer from the thermal reservoir to the engine in frigid weather prior to starting the engine.

2. The system of claim 1 wherein the fluid circuit includes heat exchangers in insulated reactant reservoirs to transfer heat from the engine during operating periods to retard freezing of the reactants during nonoperating periods in frigid weather.

3. The system of claim 1 wherein the collectable hot reaction by-products include a hydroxide of an alkali metal.

4. A method for using hot reaction by-products comprising the steps of:

transporting reactants to a reaction chamber during an operating period of substantial duration to produce a useful product and hot reaction by-products, collecting at least a portion of the hot by-products in a thermal reservoir comprising the collected by-products within an insulated vessel, transferring heat from the thermal reservoir to users during a nonoperating period of substantial duration whereby the by-products are cooled, and removing at least a portion of the cooled by-products from the thermal reservoir for replacement by hot by-products during an operating period.

5. The method of claim 4 wherein the hot by-products are nongaseous and are formed in a gas and the method further includes the step of separating the nongaseous by-products from the gas for said collection in the thermal reservoir.

6. The method of claim 5 wherein a portion of the heat of the by-products is latent heat of phase transition.

7. A process for heating a vehicle prior to starting comprising the steps of:

transporting reactants to a reaction chamber of a heat engine to form hot nongaseous by-products in a gas, separating the nongaseous by-products from the gas for storage in a thermal reservoir, transferring heat from the thermal reservoir to users in the vehicle prior to starting the vehicle, and removing at least a portion of the nongaseous by-products from the thermal reservoir.

8. The process of claim 7 wherein the nongaseous by-product is an alkali hydroxide.

9. The process of claim 7 wherein the heat is transferred from the thermal reservoir to the users by a thermal exchange fluid.

10. The process of claim 7 or 9 wherein the users include reactants communicating with the heat engine to thaw the reactants for transport to the reaction chamber.

* * * * *